US006449370B1

(12) United States Patent
Yasuno et al.

(10) Patent No.: US 6,449,370 B1
(45) **Date of Patent: *Sep. 10, 2002**

(54) DIGITAL ELECTRO-ACOUSTIC TRANSDUCER

(75) Inventors: Yoshinobu Yasuno, Tokyo (JP); Yasuhiro Riko, 1988-34, Kitahassakucho, Midori-ku, Yokohama (JP)

(73) Assignees: Matsushita Electric Industrial Co., Ltd., Osaka (JP); Yasuhiro Riko, Yokohama (JP)

( * ) Notice: Subject to any disclaimer, the term of this patent is extended or adjusted under 35 U.S.C. 154(b) by 0 days.

This patent is subject to a terminal disclaimer.

(21) Appl. No.: 09/311,142

(22) Filed: May 13, 1999

Related U.S. Application Data

(63) Continuation-in-part of application No. 09/247,872, filed on Feb. 11, 1999.

(30) Foreign Application Priority Data

| | | |
|---|---|---|
| Feb. 16, 1998 | (JP) | 10-033081 |
| May 18, 1998 | (JP) | 10-135059 |
| Jun. 18, 1998 | (JP) | 10-171865 |

(51) Int. Cl.[7] ..... H03B 29/00; H04R 3/00

(52) U.S. Cl. ..... 381/71.6; 381/111

(58) Field of Search ..... 381/111, 113, 381/116; 2/74, 71.6, 71.1, 94.5

(56) References Cited

U.S. PATENT DOCUMENTS

| | | | | |
|---|---|---|---|---|
| 4,370,523 | A | | 1/1983 | Baeder |
| 4,922,542 | A | | 5/1990 | Sapiejewski |
| 5,182,774 | A | * | 1/1993 | Bourk |
| 6,125,189 | A | * | 9/2000 | Yasuno et al. |

FOREIGN PATENT DOCUMENTS

| | | |
|---|---|---|
| EP | 0766494 | 4/1997 |
| JP | 2272998 | 11/1990 |
| JP | 4167798 | 6/1992 |
| JP | 7023492 | 1/1995 |
| JP | 10126886 | 5/1998 |
| WO | 9523456 | 8/1995 |
| WO | 9736454 | 10/1997 |

OTHER PUBLICATIONS

European Search Report dated Jan. 29, 2001.
European Search Report dated Jul. 29, 1999.
Patent Abstracts of Japan, vol. 8, No. 8 (E–221), Jan. 13, 1984 & JP 58171200 A (Tokyo Shibaura Denki KK), Oct. 7, 1983.

(List continued on next page.)

*Primary Examiner*—Forester W. Isen
*Assistant Examiner*—Brian Tyron Pendleton
(74) *Attorney, Agent, or Firm*—Stevens, Davis, Miller & Mosher, LLP

(57) ABSTRACT

A digital electro-acoustic transducer for improving the speech quality of sound under noisy circumstances is disclosed. A plurality of sound generating units A constituted by electrostatic electro-acoustic transducers (condenser earphones) and a sound receiving unit B constituted by an electrostatic acousto-electric transducer (condenser microphone) are disposed in a cavity of a soundproof housing. The units A are provided in a feedback loop and an output level of the unit B is adjusted by an preamplifier. An output of the preamplifier is sampled by a sample-and-hold circuit and an output thereof is delta-modulated by a delta modulation circuit. The number of pulses produced by the circuit is subjected to arithmetic operation in an arithmetic circuit to produce a drive signal for the units A. Vibration of a vibration film of the unit B is detected and arithmetical control is made to be always maintained to zero. On the other hand, an audio signal supplied from a signal terminal is superposed on a drive signal for the units A and is emitted into the cavity.

16 Claims, 3 Drawing Sheets

OTHER PUBLICATIONS

Patent Abstracts of Japan, vol. 5, No. 3, (E–040), Jan. 10, 1981 & JP 55134597A (Matsushita), Oct. 20, 1980.
Patent Abstracts of Japan, vol. 95, No. 11, Dec. 26, 1995 & JP 07227000A (Audio Technica Corp.), Aug. 22, 1995.
Patent Abstracts of Japan, vol. 9, No. 65 (E–304), Mar. 26, 1985 & JP 59202799A (Onkyo KK), Nov. 16, 1984.
Yanagisawa, "Present Existing State of Loudspeaker Directly Driven with Digital Signals," magazines of the Institute of Electronics Information and Communication Engineers of Japan, vol. 78, No. 5, pp. 565–569.

* cited by examiner

DIGITAL ELECTRO-ACOUSTIC TRANSDUCER

CROSS-REFERENCE TO RELATED APPLICATION

The present application is a Continuation-In-Part of U.S. patent application Ser. No. 09/247,872 filed on Feb. 11, 1999. The disclosure of that application is incorporated herein by reference.

BACKGROUND OF THE INVENTION

1. Field of the Invention

The present invention relates to an audio output apparatus of general information communication apparatuses, electro-acoustic apparatuses, measuring apparatuses and systems which deal with sound and more particularly to an antinoise or noiseproof type digital electro-acoustic transducer utilized in communication which transducer receives an audio signal from a digitized apparatus or system under noisy circumstances and produces sound.

2. Description of Related Art

Heretofore, when communication using sounds or speech sounds is made under noisy circumstances, there is a method in which a close-talking or noise-canceling type microphone is used in a transmission side. On the other hand, a noiseproof type receiver is often used in a receiving side as described in Architectural Acoustics Handbook, Gihodo, 1963. FIG. 5 shows a structure of such a receiver. In FIG. 5, numeral 11 denotes a soundproof housing, 12 a receiver body and 13 a pressure pad. Outside noise is insulated by the soundproof housing 11 to be reduced in level and reaches an ear.

However, the soundproof housing of the conventional noiseproof type receiver requires large thickness and heavy weight as a whole in order to obtain satisfactory sound insulation effect. In this case, it is troublesome to put on and operate the receiver. Further, when the receiver is put on, the pressure pad is put on the ear to cover the auricle. At this time, when the pressure exerted on the ear is increased, something wrong with the head is felt and an unpleasant feeling is given. Further, when the pressure is reduced, sound in a low frequency range, particularly, leaks from the housing and sufficient sound insulation effect cannot be obtained.

On the other hand, JP-A-10-126886 discloses a digital earphone in which electrodes of an electrostatic type electro-acoustic transducer are divided into 1:2:4:8: . . . and insulated to correspond to a plurality of bits of a digital signal and a digital microphone using the digital earphone. However, according to the literature, since one vibration plate is used in the earphone and the microphone in common, both electrodes of the earphone and the microphone must be disposed near the vibration plate, so that a structure thereof is complicated.

SUMMARY OF THE INVENTION

It is an object of the present invention to solve the above problems in the prior art by providing a noiseproof digital electro-acoustic transducer having excellent feeling of fitting and satisfactory sound insulation effect. Further, it is another object of the present invention to provide a digital electro-acoustic transducer which is simple in structure and easy to manufacture.

In order to achieve the above objects, the digital electro-acoustic transducer according to the present invention comprises a plurality of sound generating units for converting electrical signals into sounds, at least one sound receiving unit for producing an output signal in accordance with sound pressure exerted on a vibration film, a housing having a cavity in which the plurality of sound generating units and the at least one sound receiving unit are accommodated, driving means for driving the plurality of sound generating units on the basis of a drive signal, modulation means for sampling an output signal of the at least one sound receiving unit to produce a pulse in accordance with variation in amplitude of the output signal, and drive signal preparation means for calculating an arithmetic signal which reduces the amplitude of the output signal of the at least one sound receiving unit on the basis of the pulse supplied from the modulation means and superposing an externally supplied digital audio signal on the arithmetic signal to prepare the drive signal to be supplied to the driving means.

DESCRIPTION OF THE PREFERRED EMBODIMENTS

Figure 1:
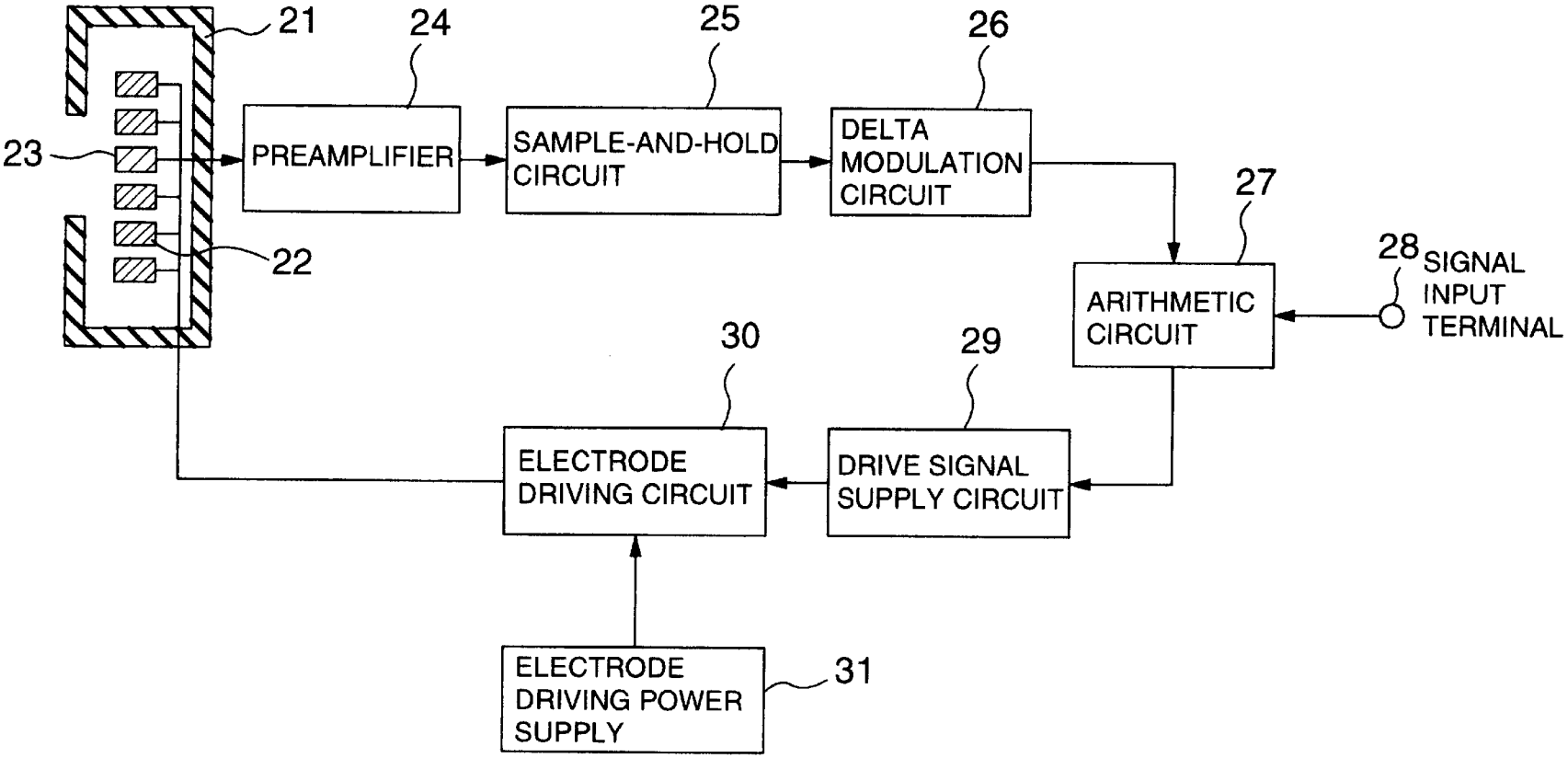
FIG. 1 is a block diagram showing a circuit configuration of an electro-acoustic transducer according to an embodiment of the present invention.

FIG. 1 schematically illustrates a digital electro-acoustic transducer according to an embodiment of the present invention. In FIG. 1, numeral 21 denotes a soundproof housing forming a cavity, 22 units A constituted by a plurality of sound generating bodies, 23 a unit B constituted by a sound receiving microphone, 24 a preamplifier, 25 a sample-and-hold circuit, 26 a delta modulation circuit, 27 an arithmetic circuit, 28 a signal input terminal, 29 a drive signal supply circuit, 30 an electrode driving circuit and 31 an electrode driving power supply.

Figure 2A:
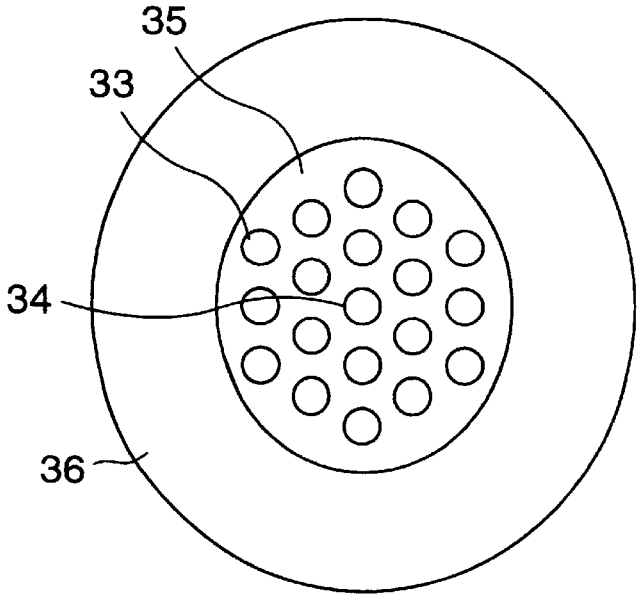
FIGS. 2A and 2B are a front view and a sectional view showing a housing portion of the electro-acoustic transducer according to the embodiment of the present invention, respectively.
Figure 2B:
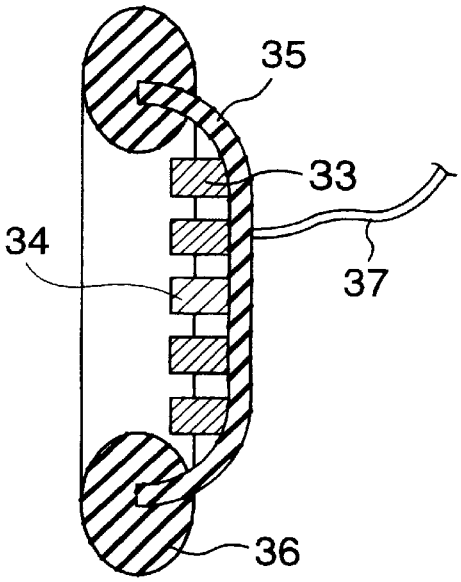
Figure 3A:
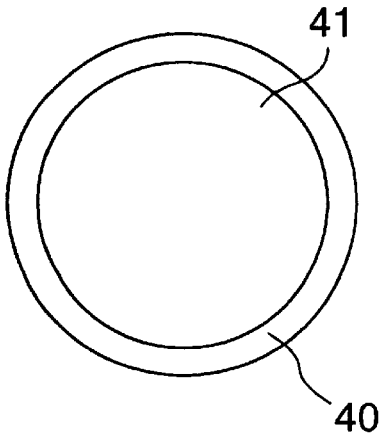
FIGS. 3A and 3B are a front view and a sectional view showing a unit A used in the electro-acoustic transducer according to the embodiment of the present invention, respectively.
Figure 3B:
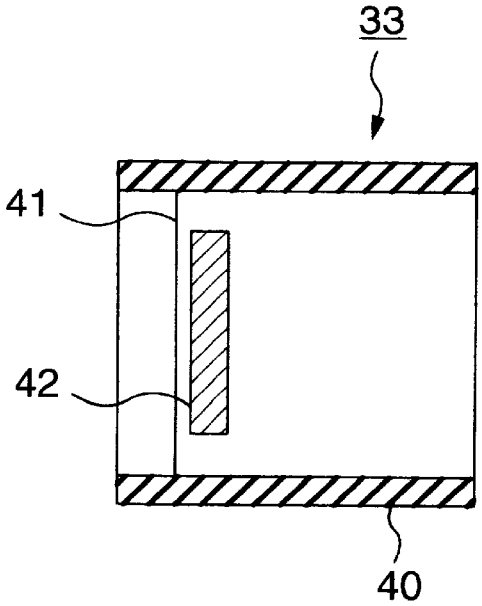
Figure 4A:
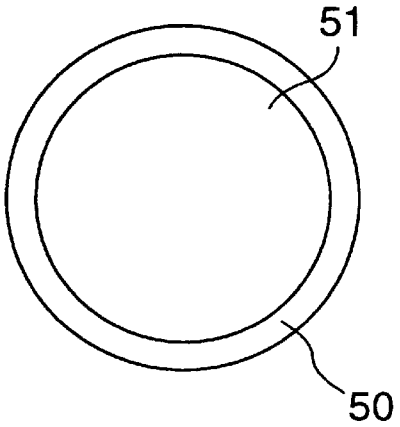
FIGS. 4A and 4B are a front view and a sectional view showing a unit B used in the electro-acoustic transducer according to the embodiment of the present invention, respectively.
Figure 4B:
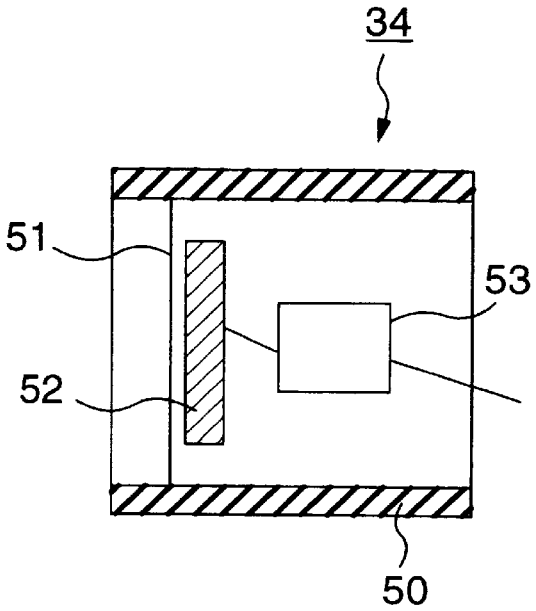
Figure 5A:
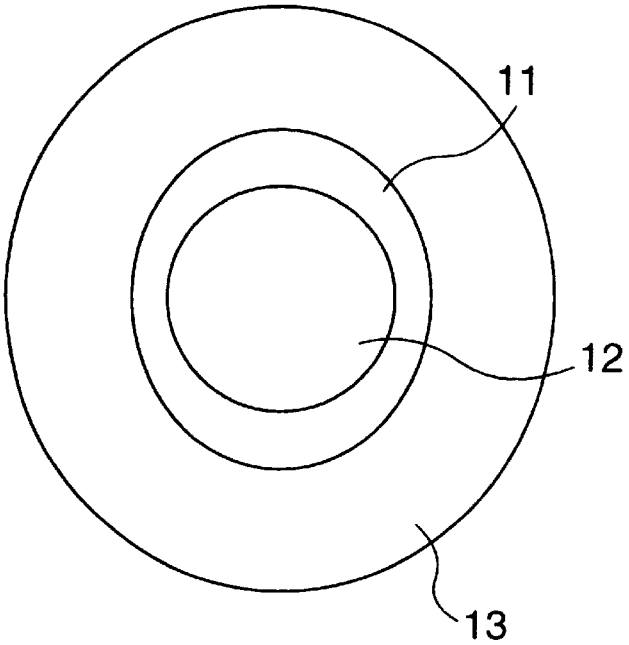
FIG. 5A PRIOR ART
FIGS. 5A and 5B are a front view and a sectional view showing a housing portion of a conventional electro-acoustic transducer.
Figure 5B:
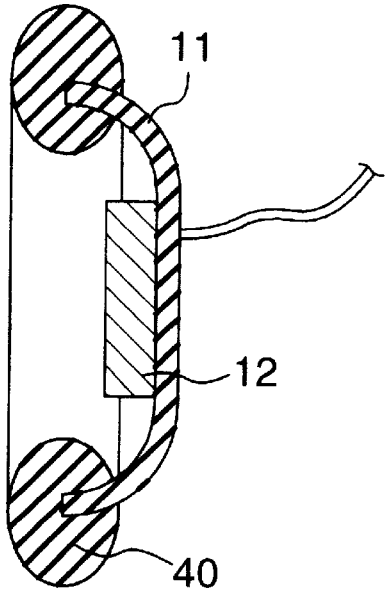
FIG. 5B PRIOR ART

FIGS. 2A and 2B show the structure of the soundproof housing of the electro-acoustic transducer according to the embodiment, the cavity formed by the housing and the units A and B disposed therein. In FIGS. 2A and 2B, numeral 33 denotes the units A, 34 the unit B, 35 the housing, 36 an ear pad and 37 a signal cable. The structure of the unit A 33 and the unit B 34 are shown in FIGS. 3A and 3B and FIGS. 4A and 4B, respectively. In FIGS. 3A and 3B, numeral 40 denotes a casing, 41 a vibration film and 42 a driving electrode. In FIGS. 4A and 4B, numeral 50 denotes a casing, 51 a vibration film, 52 a detection electrode and 53 an impedance conversion circuit. The units A are divided into groups of one unit A, two units A, four units A, eight units A, . . . which correspond to $2^0$, $2^1$, $2^2$, $2^3$, . . . , respectively. The unit B is single.

In the embodiment, electrical charges are attached by means of corona shower onto at least part of respective surfaces of the driving electrodes of the units, A 33 and the detection electrode 52 of the unit B 34 to form fluorine resin films or layers in which electrets are formed.

Further, each of the conductive vibration films 41 and 51 includes one surface on which a conductive substance is attached and the other surface on which electrical charges are attached by means of corona shower to form a fluorine resin film or layer in which an electret is formed. Alternatively, each of the conductive vibration films 41 and 51 may be composed of two film each having one surface on which a conductive substance is attached and the other surface on which electrical charges are attached to form an electret and the one surfaces of the two films are opposed to each other to be stuck together. As an alternative, each of the conductive vibration films 41 and 51 may be composed of two films each having one surface on which electrical charges are attached to form an electret and the one surfaces of the two films are opposed to each other to be stuck together.

Operation of the digital electro-acoustic transducer of embodiment is now described with reference to FIG. 1. The units A 22 which are electrostatic electro-acoustic transducers and the unit B 23 which is an electrostatic acousto-electric transducer are constituted by condenser loudspeakers and a condenser microphone, respectively. The condenser microphone and the condenser loudspeakers are well known. It is known that an output voltage of the microphone is proportional to a displacement of a vibration film by a sound pressure on the vibration film and a surface potential (or a polarization voltage) of an electret. An output sound pressure of a condenser loudspeaker is proportional to driving force exerted on a vibration film electrostatically and a magnitude thereof is determined by a product of a surface potential (or a polarization voltage) of an electret and an externally supplied signal voltage and a size of an area of a driving electrode opposite to a vibration film as well known.

Thus, the number of units A in respective groups is determined in accordance with digit positions of bits of a digital signal at the following rate:

$2^0:2^1:2^2:2^3:2^4: \ldots = 1:2:4:8:16: \ldots$

When a bit is present, the units A in the pertinent unit group are connected to the electrode driving power supply having a fixed voltage so that driving force is exerted thereon. Thus, sound having sound pressure a magnitude of which corresponds to a numerical value of the digital signal is emitted within the cavity. A magnitude of the sound pressure in the cavity produced by the whole signal is given by:

$b_0 \cdot 2^0 + b_1 \cdot 2^1 + b_2 \cdot 2^2 + \ldots$ where $b_0, b_1, b_2, \ldots$ are 0 or ±1.

More particularly, the electro-acoustic transduction and the digital-to-analog conversion by means of the units A are performed simultaneously. At this time, when it is assumed that the digital electrical signals to be applied have a fixed voltage for all of digit positions and have a sufficiently high clock frequency, the frequency characteristic of the driving force can be regarded as being flat. Further, even when products of supply voltages to individual digit positions and the number of units A in the respective groups are set at the rate described above, the same operation can be attained. Since the size of the cavity is smaller than the wavelength within a frequency range to be used, the sound pressure within the cavity is regarded as being uniform in all places.

The sound emitted within the cavity as described above is detected by the vibration detection electrode of the unit B. The detection electrode is connected to a terminal and a vibration displacement signal of the vibration film is obtained from the terminal. The detected vibration displacement signal is amplified by the preamplifier 24 and is then sampled (input sampling) by a high-speed clock signal in the sample-and-hold circuit 25. A value of the sampled signal is compared with a value of the signal sampled just before in the delta modulation circuit 26 to produce a difference therebetween. When the difference is larger than a predetermined threshold level, the delta modulation circuit 26 produces an output pulse of +1 and when the difference is smaller than the threshold, the circuit 26 produces an output pulse of −1. When the difference is within the threshold, no output pulse is produced. That is, operation of the delta modulation is performed. The output pulses of +1, −1 or 0 thus produced are regarded as being a binary signal to be supplied to the arithmetic circuit 27. The arithmetic circuit 27 adds the values of the output pulses cumulatively and always produces a new operation signal. This operation is described in JP-A-10-126886 in detail and the whole content thereof is incorporated herein by reference.

When there is no digital audio signal supplied to the signal input terminal 28 from the outside, only the signal produced by the driving force by the sound pressure exerted on the vibration film of the unit B is supplied to the arithmetic circuit 27. The drive signal supply circuit 29 samples (output sampling) the binary signal produced by the arithmetic circuit 27 by the clock matching with an interface-of connection of the electro-acoustic transducer and the outside and supplies the sampled output to the electrode driving circuit 30 in the predetermined format as an electrode drive signal. Electric power from the driving power supply 31 is supplied to the electrode driving circuit 30.

The frequency of the clock signal used from the input sampling to the cumulative addition can be set to two or more times of that of the clock signal after the output sampling to thereby attain direct conversion between the sound of the analog signal and the electrical digital signal. Further, sound pressure on the vibration film surface of the unit B produced by noise coming into the cavity from the outside and the compound sound pressure emitted from the units A in response to the signal supplied thereto from the arithmetic circuit 27 through the drive signal supply circuit 29 and the electrode driving circuit 30 balance within an error range, so that sounds within the cavity are offset. The output of the unit B is always controlled in the arithmetic circuit 27 so that it is minimized and accordingly the error comes within a range of the least significant bit of the digital signal ideally. Further, a digital audio signal is supplied to the signal input terminal 28 to be superposed on the arithmetic signal in the arithmetic circuit 27 to thereby attain an object of communication using transmission of sound.

As described above, according to the present invention, sound pressure within the cavity formed to cover the auricle of the ear is detected and sound pressure is emitted into the cavity to offset the detected sound, so that noise reaching the ear is reduced. An audio signal to be transmitted is superposed on the sound pressure to be emitted into the cavity, so that the object of communication using transmission of sound is attained. Since it is supposed that noise comes into the cavity to a certain degree, sufficient sound insulation effect can be obtained even if the receiver is relatively light and fitting pressure thereof is slight, so that there can be realized the noiseproof digital electro-acoustic transducer having excellent feeling of fitting and excellent sound insulation effect. Further, when there is no signal received, it can be used as a so-called ear-muffler.

What is claimed is:

1. A digital electro-acoustic transducer comprising:

a plurality of sound generating units for converting electrical signals into sounds;

at least one sound receiving unit for producing an output signal in accordance with sound pressure exerted on a vibration film;

a housing having a cavity in which said plurality of sound generating units and said at least one sound receiving unit are accommodated, wherein said housing is soundproof and said plurality of sound generating units and said at least one sound receiving unit are accommodated on the same plane in said cavity of said housing;

driving means for driving said plurality of sound generating units on the basis of a drive signal;

modulation means for sampling an output signal of said at least one sound receiving unit to produce a pulse in accordance with variation in amplitude of said output signal; and drive signal preparation means for calculating an arithmetic signal which reduces the amplitude of the output signal of said at least one sound receiving unit on the basis of the pulse supplied from said modulation means and superposing an externally supplied digital audio signal on said arithmetic signal to prepare said drive signal to be supplied to said driving means.

2. A digital electro-acoustic transducer according to claim 1, wherein each of said plurality of sound generating units comprises:

a conductive vibration film; and at least one electrostatic driving electrode disposed opposite to and in substantially parallel to said conductive vibration film.

3. A digital electro-acoustic transducer according to claim 1, wherein said at least one sound receiving unit comprises;

a conductive vibration film;

at least one vibration detection electrode disposed opposite to and in substantially parallel to said conductive vibration film; and an impedance conversion circuit connected electrically to said vibration detection electrode.

4. A digital electro-acoustic transducer according to claim 1, wherein said driving means comprises:

an electrode driving power supply; and an electrode driving circuit for connecting and disconnecting each of a plurality of groups of sound generating units included in said plurality of sound generating units and said electrode driving power supply;

wherein a number of sound generating units included in each of said plurality of groups of sound generating units is proportional to $2^n$ where n is 0, 1, 2, 3. . . so that each number of sound generating units corresponds to respective bit position of a digital signal.

5. A digital electro-acoustic transducer according to claim 1, wherein said driving means comprises:

a plurality of electrode driving power supplies; and an electrode driving circuit for connecting and disconnecting each of a plurality of groups of sound generating units included in said plurality of sound generating units and respective one of said plurality of electrode driving power supplies;

wherein a product of a number of sound generating units included in each of said plurality of groups of sound generating units and respective one of said plurality of electrode driving power supplies is proportional to $2^n$ where n is 0, 1, 2, 3, . . . so that each product corresponds to respective bit position of a digital signal.

6. A digital electro-acoustic transducer according to claim 1, wherein said modulation means comprises:

a preamplifier for amplifying an output signal of said sound receiving unit;

a sample-and-hold circuit for sampling an output signal of said preamplifier by using a predetermined clock frequency; and a delta modulation circuit for obtaining a difference between a value of the sampled output signal and a value sampled just before and for comparing the difference with a predetermined threshold to thereby produce one of code pulses "+1 ", "−1" and "0".

7. A digital electro-acoustic transducer according to claim 6, wherein said drive signal preparation means comprises:

an arithmetic circuit for cumulatively adding as binary value said code pulse output from said delta modulation circuit and superposing said externally supplied digital audio signal on the comulatively added binary value; and a drive signal supply circuit for sampling a signal output from said arithmetic circuit in response to a clock matching with an interface used in connection between said digital electro-acoustic transducer and an exterior and for supplying the sampled signal as said drive signal in a predetermined format to said driving means.

8. A digital electro-acoustic transducer according to claim 1, wherein said at least one sound receiving unit detects sound pressure within said cavity; and said drive signal preparation means prepares said drive signal in accordance with said detection of sound pressure so that the sound pressure within said cavity is reduced to zero within an error range when there is no digital audio signal supplied externally.

9. A digital electro-acoustic transducer according to claim 1, wherein electrical charges are attached to at least a part of each surface of electrostatic driving electrodes of said plurality of sound generating units and a vibration detection electrode of said at least one sound receiving unit to form a film in which an electret is formed.

10. A digital electro-acoustic transducer according to claim 9, wherein said film includes a fluorine resin film to which electrical charges are attached by corona shower.

11. A digital electro-acoustic transducer according to claim 1, wherein each of conductive vibration films of said plurality of sound generating units and said at least one sound receiving unit includes a film having one surface on which a conductive substance is attached and the other surface on which electrical charges are attached to form an electret.

12. A digital electro-acoustic transducer according to claim 11, wherein said film includes a fluorine resin film to which electrical charges are attached by means of corona shower.

13. A digital electro-acoustic transducer according to claim 1, wherein each of conductive vibration films of said plurality of sound generating units and said at least one sound receiving unit includes two films each having one surface on which a conductive substance is attached and the other surface on which electrical charges are attached to form an electret and said one surfaces of said two films to which said conductive material is attached are opposed to each other to stick said two films.

14. A digital electro-acoustic transducer according to claim 13, wherein each of said two films includes a fluorine resin film to which electrical charges are attached by means of corona shower.

15. A digital electro-acoustic transducer according to claim 1, wherein each of conductive vibration films of said plurality of sound generating units and said at least one sound receiving unit includes two films each having one surface to which electrical charges are attached to form an electret and said one surfaces of said two films to which said electrical charges are attached are opposed to each other to stick said two films.

16. A digital electro-acoustic transducer according to claim 15, wherein each of said two films includes a fluorine resin film to which electrical charges are attached by means of corona shower.

* * * * *